US006666670B1

(12) United States Patent
Hartman et al.

(10) Patent No.: US 6,666,670 B1
(45) Date of Patent: Dec. 23, 2003

(54) POWER STEERING PUMP

(75) Inventors: David Ray Hartman, Brighton, MI (US); Brian Stanley Modrzejewski, Livonia, MI (US); Brandon William Bailey, Dearborn, MI (US); Michael Dean Strickler, Whitmore Lake, MI (US); Rakesh Nahta, Plymouth, MI (US); Michelle Koch, Pleasant Ridge, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/443,320

(22) Filed: May 22, 2003

(51) Int. Cl.[7] ..... F03C 2/00
(52) U.S. Cl. ..... 418/133; 418/259; 418/266
(58) Field of Search ..... 418/133, 259, 418/266, 267, 268

(56) References Cited

U.S. PATENT DOCUMENTS

| | | | | | |
|---|---|---|---|---|---|
| 2,312,886 | A | * | 3/1943 | Ellinwood | 418/266 |
| 2,467,121 | A | | 4/1949 | Ferris | |
| 2,842,064 | A | | 7/1958 | Wahlmark | |
| 3,255,705 | A | * | 6/1966 | Eickmann | 418/267 |
| 3,479,962 | A | * | 11/1969 | Pettibone | 418/133 |
| 3,728,046 | A | | 4/1973 | Clark et al. | |
| 3,834,846 | A | | 9/1974 | Linder et al. | |
| 4,573,890 | A | | 3/1986 | Hadama et al. | |
| 4,619,594 | A | | 10/1986 | Moir | |
| 5,839,889 | A | | 11/1998 | Folsom et al. | |
| 5,876,194 | A | | 3/1999 | Suelter | |
| 5,887,612 | A | | 3/1999 | Bleitz et al. | |
| 6,287,094 | B1 | | 9/2001 | Bleitz et al. | |
| 6,497,565 | B2 | | 12/2002 | Inaguma et al. | |

* cited by examiner

*Primary Examiner*—Thomas Denion
*Assistant Examiner*—Theresa Trieu
(74) *Attorney, Agent, or Firm*—Brinks Hofer Gilson & Lione

(57) ABSTRACT

A power steering pump for an automotive vehicle includes a housing having an inner wall with an axial groove. A cam plate that defines a cam chamber is received in the housing and includes a rib received in the groove. The groove and rib are disposed near the outlet port of the cam chamber and are dimensioned such that, during operation, distortion of the cam plate directs the rib into locking engagement with the groove while maintaining clearance between the housing and remainder of the cam plate to reduce propagation of vibration and noise.

12 Claims, 2 Drawing Sheets

POWER STEERING PUMP

TECHNICAL FIELD OF THE INVENTION

This invention relates to a power steering pump for an automotive vehicle and, more particularly, to a power steering pump that includes a cam plate accurately located within a housing.

BACKGROUND OF THE INVENTION

A power steering system of an automotive vehicle comprises a pump for supplying hydraulic fluid under pressure to a power steering gear assembly. A typical power steering pump comprises a rotor having retractable vanes and rotating within a cam chamber. The circumference of the cam chamber is defined by a cam plate that is interposed between upper and lower pressure plates and assembled within a housing. The housing is connected to the steering gear assembly for receiving spent fluid. Suction passages within the housing convey the fluid to inlets to the cam chamber formed in the pressure plates. Pressurized fluid is discharged through outlets in the pressure plate to discharge passages that are connected to the gear assembly. Typically, a flow control assembly regulates the output from the pump and recycles excess fluid through a bypass port to the suction passages. During operation, the rotor is driven by the engine through a belt and pulley mechanism. The rotor draws fluid from the suction passage through the inlets, compresses the fluid, and discharges pressurized fluid through the outlets to the discharge passages that lead to the steering gear assembly.

The cam plate must be accurately aligned in the housing to register the cam chamber with the inlets and outlets. This is typically accomplished by alignment pins extending through bores in the cam plate, or between the perimeter of the cam plate and the housing. Furthermore, the cam chamber typically includes two inlet regions for receiving low pressure fluid and two outlet regions for discharging high pressure fluid. The outlet regions are diametrically arranged to balance the forces created by the high pressure fluid, and similarly the inlet regions are diametrically arranged. In general, it is desired to minimize the radial width of the cam plate to reduce the weight and cost of the pump. However, because of the high pressure of the fluid at the outlet regions, which may exceed 2,500 psi, and the differences in pressures with the inlet regions, forces develop within the cam plate that tend to distort the cam chamber, or even create stresses that may cause catastrophic fracture of the plate. Also, vibration of the cam plate during operation results in noise. Moreover, pressure distortion of the cam plate, and vibration of the alignment pins, increases the noise emanating from the pump.

Therefore, a need exists for a power steering pump that includes a cam plate that is accurately aligned within the pump housing to register the cam chamber with the inlets and outlets, and further that is able to reduce vibration and noise, including noise due to vibration of the cam plate and distortion of the cam chamber. There is also a need to reduce the size and number of components of the pump, while minimizing the vibration and noise, to thereby reduce the size and cost of the pump.

BRIEF SUMMARY OF THE INVENTION

This invention provides a power steering pump for an automotive vehicle that includes a housing having an inner housing wall about an axis, and a cam plate received in the housing. The cam plate defines a cam chamber and includes an perimeter spaced apart from the inner housing wall. The pump also includes a rotor coaxially received in the cam chamber and comprising retractable vanes that cooperate with the cam chamber to pressurize fluid. One or more outlets communicate with the cam chamber for discharging pressurized fluid. In accordance with this invention, the inner housing wall includes an axial groove and the cam plate includes a locator rib received in the groove. The groove and rib are disposed adjacent the outlet port. In the absence of pressurized fluid within the cam chamber, the outer surface of the cam plate about the rib is radially spaced apart from the housing inner surface by a first dimension, and the rib is radially spaced apart from the groove by a second dimension that is less than the first dimension. During operation, the retractable vanes of the rotor cooperate with the cam chamber to pressure fluid adjacent the outlet port. Distortion of the cam plate due to operating fluid pressures directs the rib into a locking engagement within the groove, while maintaining clearance between the housing and the remainder of the cam plate outer surface. This not only accurately positions the cam plate within the housing, but also, secures the cam plate to reduce vibration. Also, the remaining clearance inhibits vibration propagation from the cam plate to the housing. Thus, this invention provides a power steering pump that exhibits reduced noise during operation.

BRIEF DESCRIPTION OF THE DRAWINGS

This invention will be further described with reference to the drawings wherein.

DETAILED DESCRIPTION OF THE INVENTION

Figure 1:
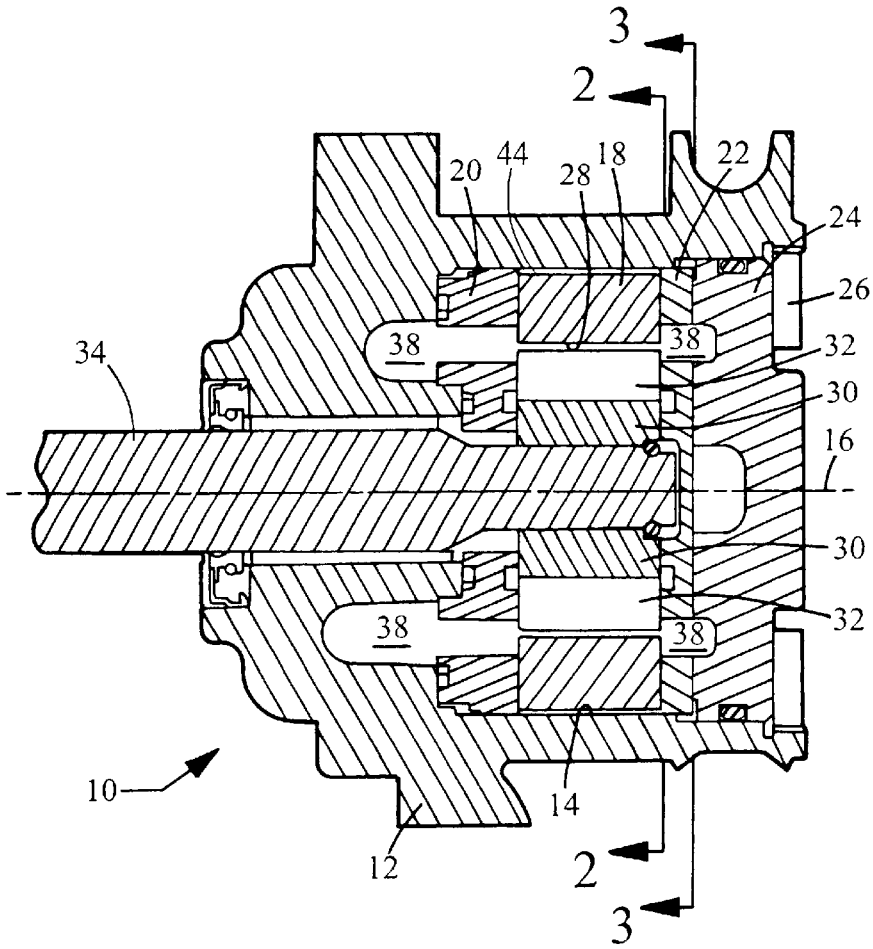
FIG. 1 is a cross-sectional view a power steering pump in accordance with this invention.
Figure 2:
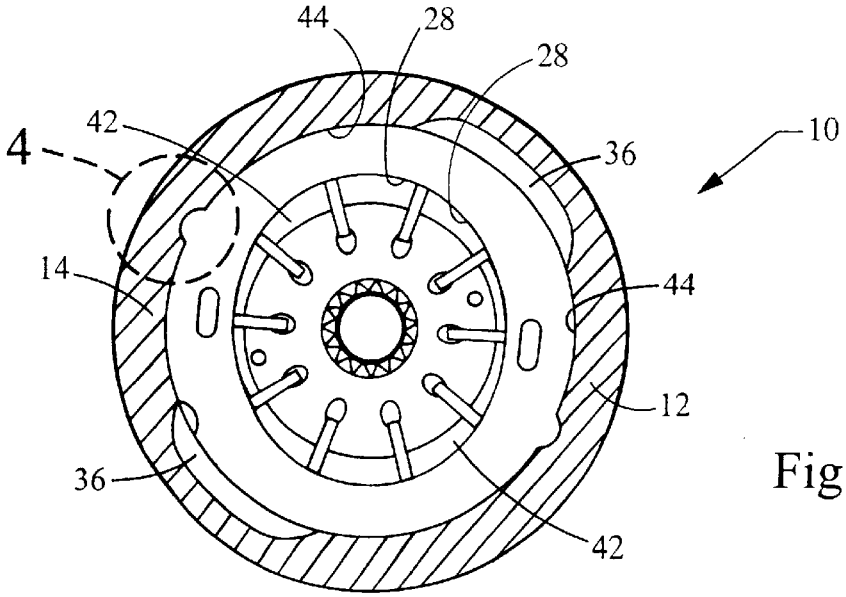
FIG. 2 is a cross-section of the pump in FIG. 1 taken along lines 2—2 in the direction of the arrows.

In accordance with a preferred embodiment of this invention, referring to the Figs., a power steering pump 10 is adapted for use in a power steering system of an automotive vehicle for providing pressurized fluid to a power steering gear assembly. Pump 10 comprises a canister housing 12 that defines a compartment surrounded by an inner wall 14 generally cylindrical about an axis 16. Received within the compartment is a cam plate 18, a lower pressure plate 20 and an upper pressure plate 22. Plates 18, 20 and 22 are enclosed by a cover 24 secured by a retaining ring 26.

Cam plate 18 defines a cam chamber 28. A rotor 30 is disposed within cam chamber 28 and mounted on a shaft 34 that extends through housing 12. Shaft 34 is adapted to be driven by the vehicle motor through a belt and pulley arrangement and rotates rotor 30 about axis 16. Rotor 30 includes radially slideable vanes 32 that engage the surface of cam chamber 28 to pump fluid as rotor 30 is rotated.

The several elements of pump 10 cooperate to define suction passages 36 for conveying relatively low pressure fluid to cam chamber 28 and discharge passages 38 for conveying pressurized fluid from cam chamber 28. Fluid enters the cam chamber from the suction passages through inlets 40. Fluid exits to discharge passages 38 through outlets 42. It would be appreciated that only a portion of the suction passages 36 and the discharge passages 38 are depicted in the figures, and that additional passages are provided for conveying the fluid from the pump inlet and to the pump outlet. Also, pump 10 may include bypass porting to regulate the output from the pump and return a portion of the pressurized fluid to the suction passages. It is a feature of this embodiment that outlets 42 are diametrically opposed about axis 16 for balancing the pressures therebetween during operation. Similarly, inlets 40 are diametrically opposed. During operation, the fluid pressures within cam chamber 28 in the outlet regions adjacent outlets 42 are substantially higher than in the inlet regions adjacent inlet 40. Moreover, the relatively high discharge pressures and the non-uniform pressure distribution tend to distort the size and shape of the cam chamber.

Figure 3:
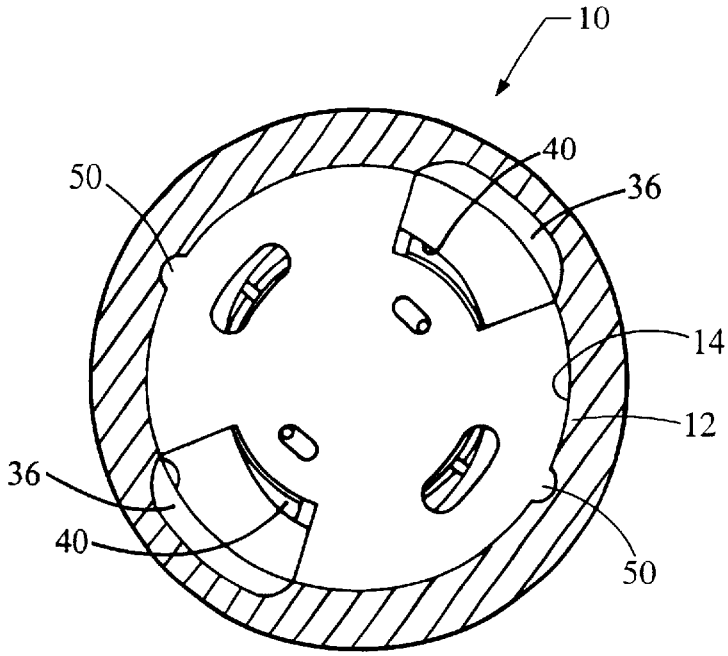
FIG. 3 is a cross sectional view of the pump in FIG. 1 taken along lines 3—3 in the direction of the arrows.
Figure 4:
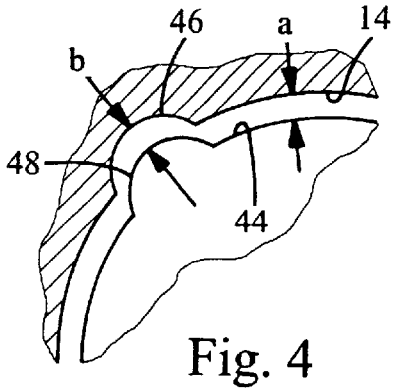
FIG. 4 is an enlarged view showing the region within circle 4 of FIG. 2 prior to operation.

In accordance with this invention, cam plate 18 comprises perimeter 44 spaced apart from inner wall 14 of housing 12. Also, housing 12 comprises axial grooves 46, and cam plate 18 comprises axial locator ribs 48 received in grooves 46. Preferably, the rib has a semicircular cross section perpendicular to the axis, and the groove has a similar semicircular cross section sized and shaped to conform to the rib. Referring particularly to FIG. 4, perimeter 44 of cam plate 28 is spaced apart from inner wall 14 to provide clearance for assembling the cam plate into the housing. Except at rib 48, the cam plate is separated from the housing by a first radial dimension a. In contrast, ribs 48 are spaced apart from grooves 46 by a second radial dimension b that is less than a. By way of example, clearance a may typically be within the range of 0.3 mm to 0.6 mm; whereas clearance b is preferably less than 0.05 mm, and by way of example, a clearance b of 0.015 mm has been achieved. In addition, lower pressure plate 20 includes ribs, and upper pressure plate 22 includes ribs 50 in FIG. 3, that are also received in grooves 46 and register with ribs 48, thereby providing accurate circumferential arrangement of the pressure plates and cam chamber 28. It is a feature of this invention that grooves 46 and ribs 48 are disposed adjacent outlets 42 and the associated regions of cam chamber 28 that contain pressurized fluid during operation. In this manner, ribs 48 provide reinforcement of cam plate 18 in regions where distortion tends to occur.

Figure 5:
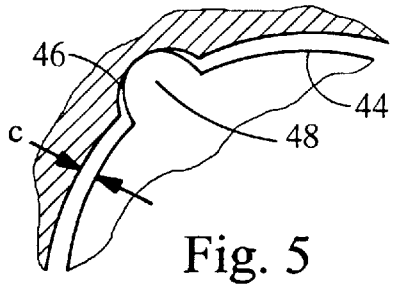
FIG. 5 is an enlarged view comparable to FIG. 4 showing the region during high pressure operation.

During operation, shaft 34 is driven about axis 16 to rotate rotor 30 within cam chamber 28. Relatively low pressure fluid is drawn into cam chamber 28 through inlets 40. Within the cam chamber, the fluid is compressed by vanes 32, and the pressurized fluid is discharged through outlets 42. The pressurized fluid adjacent outlets 42 tend to distort cam plate 18 radially outward. Referring to FIG. 5, as the cam plate becomes distorted, rib 48 extends into contact with groove 46. Thus, rib 48 registers with groove 46 to prevent circumferential deflection of the cam plate and maintain alignment of the cam plate with the upper and lower pressure plates 20 and 22 in the desired arrangement with the inlets 40 and outlets 42. In addition, as rib 48 engages groove 46, housing 12 provides additional reinforcement of cam plate 18 in the regions of the pressurized fluid to prevent further distortion of the cam plate. Still further, because greater clearance is provided between outer surface 44 and inner wall 14 of housing 12 about rib 48, upon contact between rib 48 and groove 46, radial clearance c remains between the cam plate and the housing. This remaining clearance isolates the cam plate from the housing to inhibit propagation of vibrations and reduce noise associated therewith.

Therefore, this invention provides an improved power steering pump for an automotive vehicle that includes a rib protruding from the perimeter of the cam plate and received in an axial groove in the housing. The rib together with similar locating ribs on the upper and lower pressure plates, serves to accurately locate the elements within the housing, including the inlets and outlets to and from the cam chamber. In addition, clearance is reduced between the rib and groove radially relative to the surrounding surfaces of the cam plate in the housing. Thus, during operation, distortion of the cam plate attributed to high pressures developed within the cam chamber cause the rib to engage the groove, while still providing clearance about the majority of the cam plate. This assists in isolating vibrations and noise generated within the cam chamber from propagating to the housing. This reduces vibration and noise associated with the operation of the pump. Still further, the locating ribs are integral with the cam plate and are disposed adjacent high pressure regions within the cam chamber. This increases the radial width of the cam plate, and thus the strength, in those regions that experience increased stress due to high pressures within the cam chamber. In addition, the housing reinforces the cam through the ribs in the high pressure regions where strengthening is critical. However, the clearance between the cam plate and the housing in other regions, including low pressure regions, provides a barrier to vibrations that would otherwise propagate and produce noise. This is accomplished while eliminating locator pins or other components required for location of the cam plate, thereby reducing the number of components and cost for the power steering pump.

While this invention has been described in terms of certain embodiments thereof, it is not intended to be so limited, but rather only to this extend set forth in the claims that follow.

What is claimed is:

1. A power steering pump for an automotive vehicle comprising:

a housing having an Inner housing wall about an axis, said inner housing wall comprising at least one axial groove;

a cam plate received in the housing and defining a cam chamber, said cam plate comprising a perimeter adjacent said inner housing wall and a locator rib received in the axial groove;

a rotor coaxially received in the cam chamber and comprising retractable vanes that cooperate with the cam chamber to pressurize fluid; and an outlet communicating with the cam chamber for discharging pressurized fluid from said cam chamber, wherein the axial groove and locator rib are disposed adjacent the outlet port, and wherein, in the absence of pressurized fluid within the cam chamber, the perimeter of the cam plate about the rib is radially spaced apart from the inner housing wall by a first dimension and the locator rib is radially spaced apart from the groove by a second dimension less than the first dimension.

2. A power steering pump in accordance with claim 1 wherein the housing is generally cylindrical about the axis.

3. A power steering pump in accordance with claim 1 wherein the axis corresponds to an axis of rotation of the rotor.

4. A power steering pump in accordance with claim 1 wherein the locator rib has a generally semispherical cross section perpendicular to the axis.

5. A power steering pump in accordance with claim 4 wherein the axial groove has a generally semispherical cross section sized and shaped to conform with the locator rib.

6. A power steering pump in accordance with claim 1 wherein said locator rib is adapted to engage said groove as a result of distortion of said cam plate during operation.

7. A power steering pump in accordance with claim 1 wherein said locator rib is adapted to engage said groove while maintaining clearance between said housing and the perimeter of said cam plate about said groove.

8. A power steering pump in accordance with claim 1 further comprising an upper pressure plate comprising a locator rib received in said axial groove.

9. A power steering pump in accordance with claim 1 further comprising a lower pressure plate comprising a locator rib received in said axial groove.

10. A power steering pump in accordance with claim 1 wherein said inner housing wall comprises two axial grooves, and said cam plate comprises two locator ribs, such that each locator rib is received in one said axial groove, and further said locator ribs are arranged in diametrically opposite relationship.

11. A power steering pump for an automotive vehicle comprising:

a housing having an inner housing wall about an axis, said inner wall comprising at least two axial grooves;

a cam plate received in said housing and defining a cam chamber having two inlet regions and two outlet regions disposed in diametrically opposite relationship, said cam plate comprising a perimeter and at least two locator ribs protruding from said perimeter, each said locator rib being received in one said axial groove;

pressure plates disposed about said cam plate and comprising locator ribs received in said axial grooves, said pressure plates comprising inlets communicating with said cam chamber at said inlet regions and outlets communicating with said cam chamber at said outlet regions; and a rotor received in said cam chamber and comprising retractable vanes that cooperate with the cam chamber to draw in fluid at said inlet regions and to pressurize fluid at said outlet regions; and wherein, in the absence of pressurized fluid within the cam chamber, the perimeter of the cam plate about the locator ribs is radially spaced apart from the inner housing wall by a first dimension and the locator rib is radially spaced from the groove by a second dimension less than the first dimension.

12. A power steering pump for an automotive vehicle in accordance to claim 11 further wherein, during operation of the power steering pump, said locator ribs engage said grooves as a result of distortion of said cam plate due to fluid pressures with said cam chamber.

* * * * *